United States Patent [19]

Musschoot

[11] Patent Number: 4,859,070

[45] Date of Patent: Aug. 22, 1989

[54] OMNIAXIS APPARATUS FOR PROCESSING PARTICULATES AND THE LIKE

[75] Inventor: Albert Musschoot, Barrington, Ill.

[73] Assignee: General Kinematics Corporation, Barrington, Ill.

[21] Appl. No.: 34,753

[22] Filed: Apr. 6, 1987

Related U.S. Application Data

[63] Continuation-in-part of Ser. No. 855,130, Apr. 23, 1986, abandoned.

[51] Int. Cl.[4] ..... B01F 11/00; B22C 15/10

[52] U.S. Cl. ..... 366/114; 366/116; 366/125; 366/128; 74/87; 164/203

[58] Field of Search ..... 366/108, 110–112, 366/114, 116, 124–126, 128; 164/39, 260, 203, 416, 206, 34, 35, 196; 198/756, 757, 759, 766, 768, 770; 51/163.1, 163.2; 241/175; 74/61, 87

[56] References Cited

U.S. PATENT DOCUMENTS

| | | | |
|---|---|---|---|
| Re. 22,904 | 8/1947 | Carrier, Jr. . | |
| 1,138,457 | 5/1915 | Dahlmeyer | 164/203 |
| 2,169,279 | 8/1939 | Oyster . | |
| 2,247,978 | 7/1941 | Van Arel | 366/110 |
| 2,531,706 | 11/1950 | Signeul . | |
| 2,658,286 | 11/1953 | Spurlin . | |
| 2,760,503 | 8/1956 | Carrier, Jr. . | |
| 2,760,504 | 8/1956 | Spurlin . | |
| 2,771,983 | 11/1956 | Carrier, Jr. . | |
| 2,922,514 | 1/1960 | Carrier, Jr. . | |
| 2,946,429 | 7/1960 | Carrier, Jr. . | |
| 3,059,483 | 10/1962 | Clynch et al. | 366/125 |
| 3,171,538 | 3/1965 | Hagenbook . | |
| 3,178,013 | 4/1965 | Hubbard . | |
| 3,207,293 | 9/1965 | White . | |
| 3,216,431 | 11/1965 | White . | |
| 3,246,737 | 4/1966 | Allen et al. . | |
| 3,258,112 | 6/1966 | Allen et al. . | |
| 3,258,852 | 7/1966 | White . | |
| 3,292,775 | 12/1966 | White . | |
| 3,358,815 | 12/1967 | Musschoot et al. | 198/770 |
| 3,396,947 | 8/1968 | Heden . | |
| 3,435,564 | 4/1969 | Balz . | |
| 3,514,907 | 6/1970 | Strom | 241/175 |
| 3,848,343 | 11/1974 | Musschoot | 34/164 |
| 3,850,288 | 11/1974 | Musschoot | 198/220 BA |
| 3,877,178 | 4/1975 | Campanelli | 51/163.2 |
| 3,882,820 | 5/1975 | Hock et al. | 118/603 |
| 3,916,575 | 11/1975 | Smith | 241/175 |
| 4,022,638 | 5/1977 | Weet | 134/1 |
| 4,042,181 | 8/1977 | Huber et al. | 241/175 |
| 4,140,215 | 2/1979 | Musschoot | 198/771 |
| 4,207,005 | 6/1980 | Stonfield | 366/108 |
| 4,245,737 | 1/1981 | Pellerin et al. | 198/756 |
| 4,288,165 | 9/1981 | Fewel | 366/124 |
| 4,454,906 | 6/1984 | Musschoot | 164/34 |
| 4,461,122 | 7/1984 | Balz | 51/163.2 |
| 4,495,826 | 1/1985 | Musschoot | 198/770 |
| 4,523,486 | 6/1985 | Bueno | 366/128 |
| 4,550,622 | 11/1985 | LaBonte et al. | 366/128 |
| 4,593,739 | 6/1986 | VanRens et al. | 164/34 |

FOREIGN PATENT DOCUMENTS

| | | | |
|---|---|---|---|
| 348275 | 9/1972 | U.S.S.R. | 366/108 |
| 769547 | 3/1957 | United Kingdom | 74/61 |
| 2130784A | 6/1984 | United Kingdom . | |

*Primary Examiner*—Harvey C. Hornsby

*Assistant Examiner*—Joseph S. Machuga

*Attorney, Agent, or Firm*—Wood, Dalton, Phillips, Mason & Rowe

[57] ABSTRACT

An apparatus for processing particulates comprises a vibratory bed including a motor with a vertically disposed shaft, separate remotely adjustable vibratory generating apparatus mounted on each end portion of the shaft and at least three contact structures between the vibratory bed and a flask or vessel containing the particulates. The uppermost vibratory generating apparatus being remotely adjustable to vary the horizontal vibratory force component and the lowermost vibratory generating apparatus being remotely adjustable to vary the vertical conical force component. The contact structures have conically shaped mating surfaces on pins and in recesses in sockets such that when at least one of the conically shaped surfaces are in contact the vessel is restrained to the same horizontal movement as the bed plate. When vibrational gyratory motion of the bed plate has an acceleration in excess of gravity, the bed plate will impact the vessel with a vertical component progressively from one contact structure to the next at multiple frequencies for each revolution of the shaft. The impacts at the multiple frequencies will fluidize the particulates so that the particulates will flow into cavities and crevices in a pattern or the like in the vessel.

19 Claims, 4 Drawing Sheets

FIG. 6
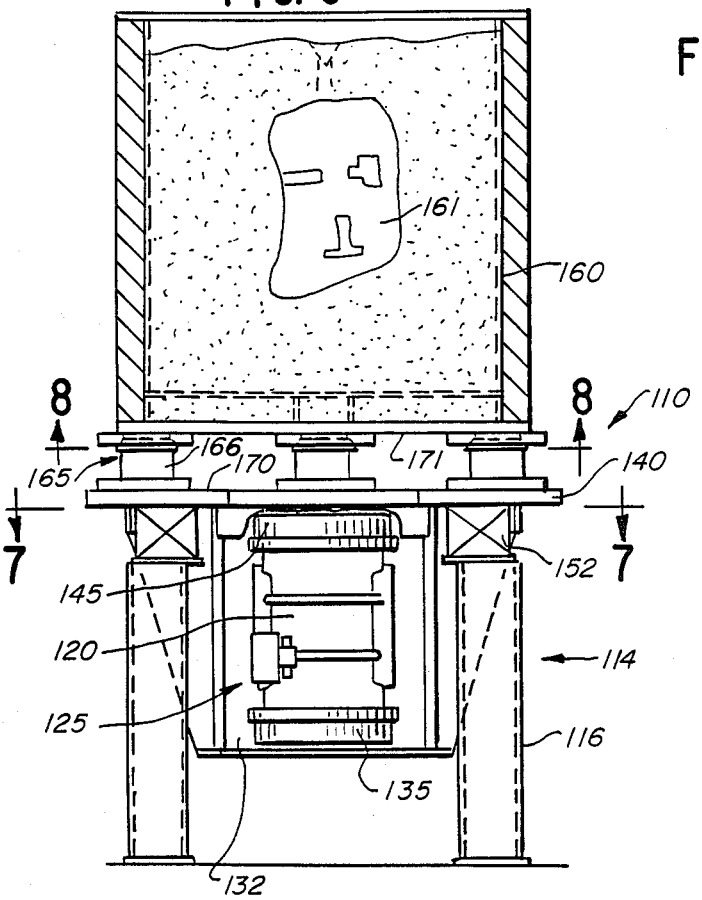
FIG. 9
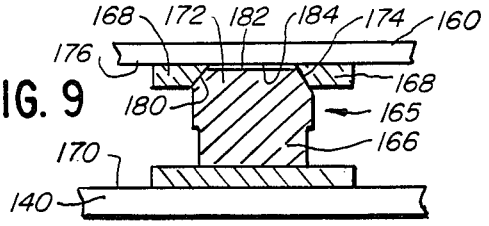
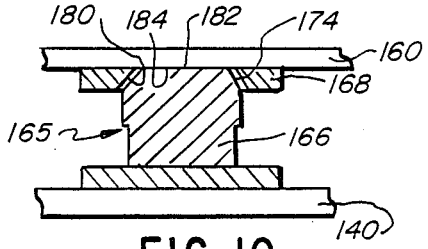
FIG. 10
FIG. 8
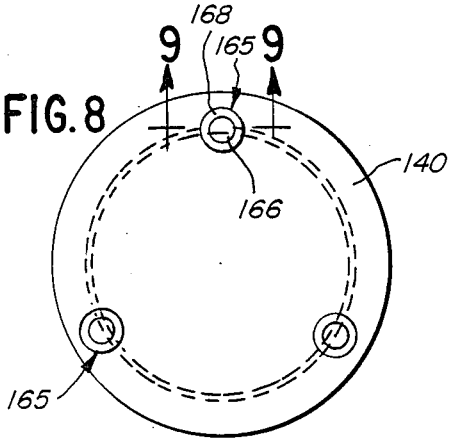
FIG. 7
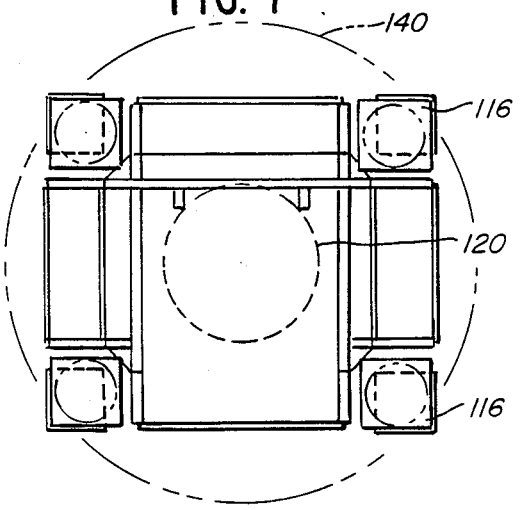
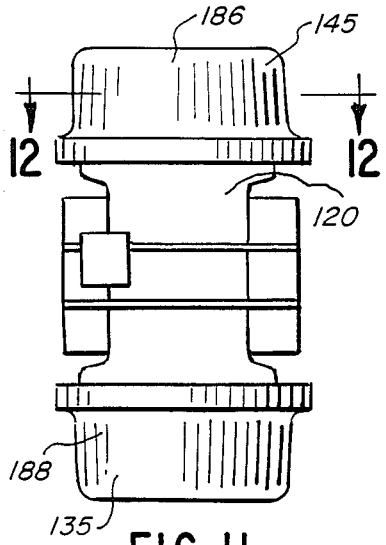
FIG. 11

FIG. 12
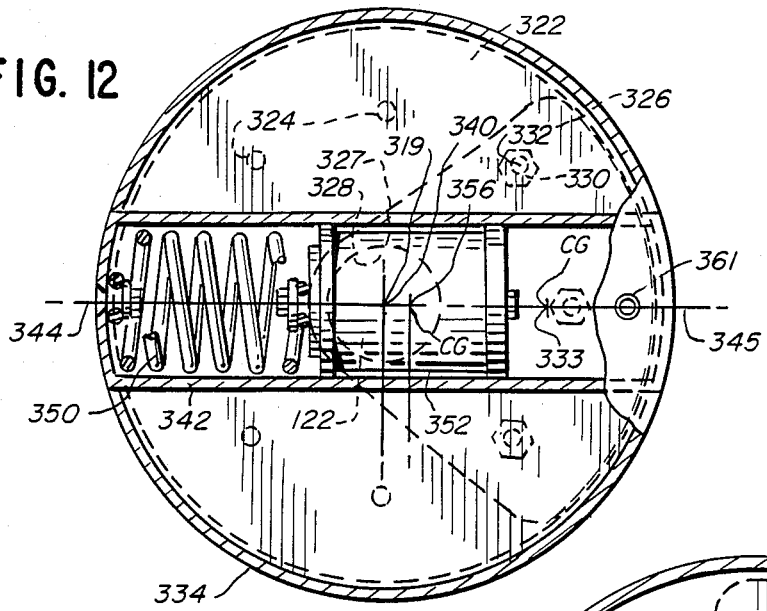
FIG. 13
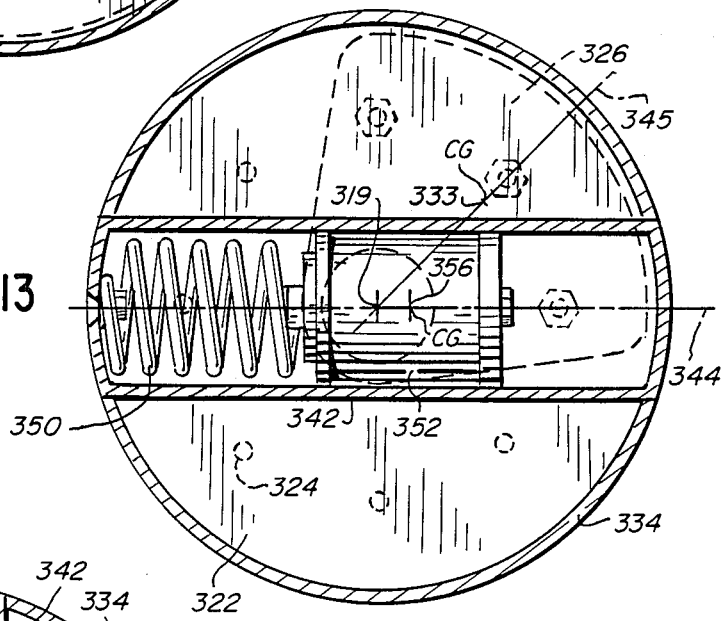
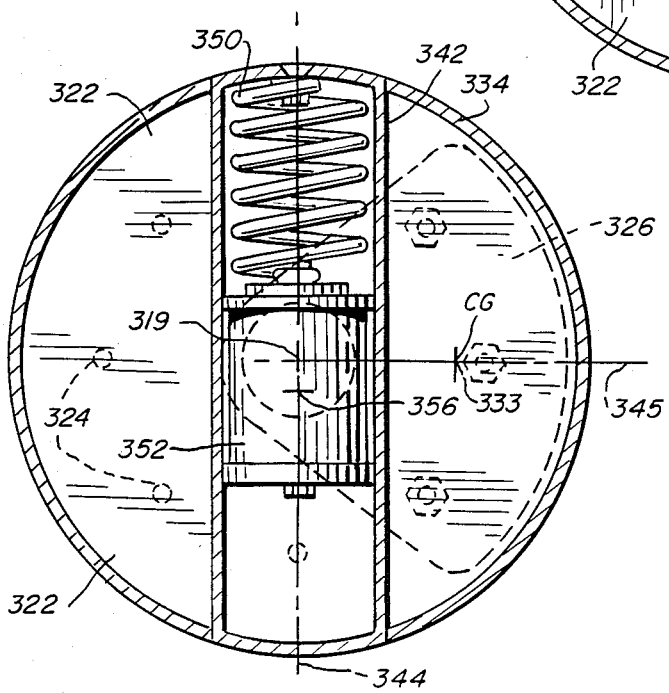
FIG. 14

OMNIAXIS APPARATUS FOR PROCESSING PARTICULATES AND THE LIKE

DESCRIPTION

This application is a continuation-in-part application of application Ser. No. 855,130, filed Apr. 23, 1986, now abandoned.

TECHNICAL FIELD

The present invention relates generally to vibratory apparatus, and more particularly to an apparatus for processing particulates or the like.

BACKGROUND ART

Often, it is desirable to compact loose particulates to remove air voids therefrom. One example is in a metal casting process in which foundry sand is compacted about a pattern to create a mold. In some cases, the pattern may be of such oomplex shape that special techniques must be used to ensure that all air voids are removed from the particulate matter and all passages and cavities in the pattern are filled. One prior method of compacting particulates about a complex pattern is disclosed in applicant's prior U.S. Pat. No. 4,456,906, assigned to the assignee of the instant application.

The above-noted patent discloses a vibratory method which utilizes an apparatus havigg vibration generators comprising horizontally mounted motors having eccentric weights thereon. The generators are operated to vibrate a bed which in turn supports a flask containing the pattern and foundry sand. Initially, the generators are operated to produce a vibratory acceleration on the mold flask and its contents in excess of the acceleration due to gravity. This acceleration causes the sand to fluidize and thus flow into and completely fill cavities in the pattern. After a short period of vibration at accelerations in excess of gravity, the stroke of the motors is reduced to reduce the acceleration to a magnitude less than the acceleration of gravity. This in turn compacts the foundry sand in place allowing it to retain its position when molten metal is subsequently introduced into the mold flask.

Certain prior compaction apparatus often permitted the horizontal and vertical component of the vibratory forces of the vibratory apparatus to be partially dissipated between the bed plate and the flask due to an unclamped coupling between the two, resulting in less than efficient compaction of material in the flask.

Other prior art devices, such as shown in U.S. Pat. No. 3,435,564 to Balz has a motor with a vertical shaft and adjustable eccentric weights on each end of the shaft. Each time the conditions of operation change, i.e. heavier parts are being handled, the apparatus has to be shut down and the eccentric weights repositioned to new locations relative to the motor shaft so as to change the operating range of the apparatus to meet the new conditions. Shut downs add costs to the finished product.

SUMMARY OF THE INVENTION

In accordance with the present invention, an apparatus for processing particulates including fluidizing and/or compacting same accomplishes such objectives in a simple and effective fashion. The apparatus has directionally operable contact structures between the bed plate and the flask or vessel and includes remotely adjustable variable rate vibratory members for changing not only the horizontal components of the vibratory forces but also for changing the vertical gyratory components acting on the flask or vessel.

The apparatus includes a vibratory bed, a base, a suspension coupled between the vibratory bed and the base whereby vibration of the vibratory bed is isolated from the base and a vessel carried by the vibratory bed for holding the particulates wherein vibrational motion of the vibratory bed in turn causes the vessel to vibrate and thereby fluidize and/or compact thepparticulates. The vibratory bed includes a motor having a vertically disposed shaft, at least one cceentric weightddisposed nn the shaft, a housing secured to and enclosing the motor and a bed plate disposed atop the housing wherein operation of the motor imparts vibrational motion to the bed plate. Advantageously, this motion is vibrogyratory in nature along an axis which, if upwardly projected, would describe the surface of an inverted cone.

In the preferred embodiment, the motor shaft includes first and second ends which extend outwardly from the motor and first and second eccentric weights adjustably mounted radially outwardly from the shaft so that the amplitude of the vibrations imparted to the vibratory bed can be varied. Unlike prior devices, it has been discovered that during operation of the instant invention at a constant motor speed, the vertical components of the vibrations at various contact points, when the apparatus is operating with the acceleration close to or in excess of gravity, produces multiple impacts for each revolution of the shaft at frequencies which are multiples of a fundamental frequency. This multi-frequency vibration quickly and effectively fluidizes the particulates so that all of the cavities in the pattern are filled without damage to the pattern.

In one form of the invention there are at least three contact points or structures between the flask or vessel and the bed plate whereupon operating the apparatus with an acceleration in excess of gravity will create a number of multiples of the fundamental frequency equal to the number of contact points. Increasing the number of contact points increases the ratio of impact frequency to shaft revolutions per minute.

Also provided are means for maintaining substantial relative alignment of the vessel and the bed plate so that rotation of vessel relative to the bed plate is prevented.

In an improved version the contact points are comprised of three or more pins mounted equidistant apart on the bed plate with each pin having frusto-conical upwardly projecting end portions seating in mating frusto-conical sockets on the flask plate. With at least one of the sloping surfaces of the frusto-conical pins and sockets mating and in contact, the horizontal vibratory component of the vibration generating apparatus is transmitted directly to the flask and its contents. However, the vertical vibrogyratory motions of the vibration generating apparatus are transmitted vertically progressively through successive pins producing vertical impacts on the flask in a wobble plate type action. Some of the pins bottom in the sockets without the frusto-conical surfaces being in continuous contact, however, those pins as well as the pins having contacting frusto-conical surfaces with the sockets transmit vertical components from the bed plate to the flask or vessel.

A further improvement on the vibratory generating apparatus is the incorporation of remotely adjustable force varying structure on the vibratory generators mounted on the opposite end portions of the vertical shaft of the motor whereby the horizontal vibratory movements transmitted to the flask can be widely varied by varying the force generated by the uppermost vibratory generator on the motor shaft. In addition, the vertical and/or vibrogyratory movements transmitted to the flask can be varied by varying the force generated by the lowermost vibratory generator on the motor shaft. The ability to simply and remotely vary either or both of the upper and/or lower vibratory generating apparatus makes it possible to adjust the system to meet any desired condition.

BRIEF DESCRIPTION OF THE DRAWINGS

FIG. 6 is an elevational view of a modified form of the apparatus;

FIG. 7 is a cross-sectional view taken along the lines 7—7 of FIG. 6;

FIG. 8 is a cross-sectional view taken along the lines 8—8 of FIG. 6, only in slightly reduced scale;

FIG. 9 is a cross-sectional view taken along the lines 9—9 of FIG. 8;

FIG. 10 is a cross-sectional view similar to FIG. 9 only showing a modified form of pin and socket connection;

FIG. 11 is a view of the motor and vibratory generators of FIG. 6 in slightly enlarge scale and removed from the apparatus of FIG. 6;

FIG. 12 is a cross-sectional view of a vibratory force varying structure taken along the lines 12—12 of FIG. 1;

FIG. 13 is a view similar to FIG. 12 only with the moveable weight displaced from the position of FIG. 12; and FIG. 14 is a cross-sectional view of the vibratory force varying structure of FIG. 12 only with the fixed weight reset in a different location from FIG. 12.

DESCRIPTION OF THE PREFERRED EMBODIMENT

Figure 1:
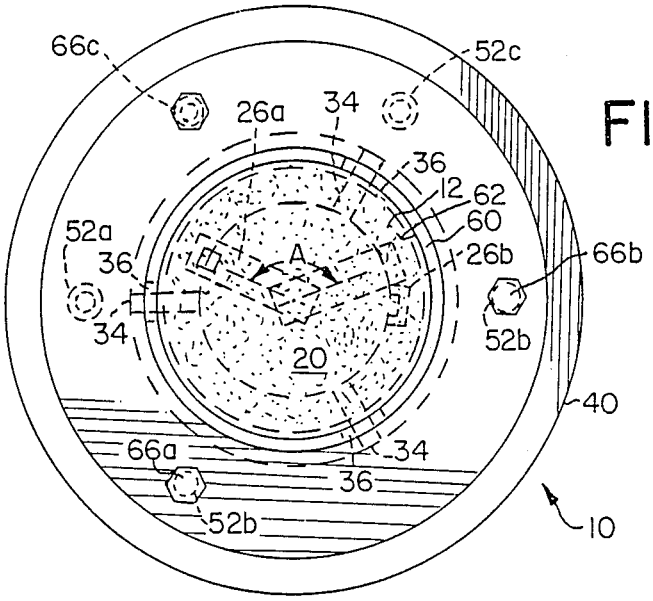
FIG. 1 is a plan view, partially in phantom, of the compaction apparatus of the present invention.

Referring now to the figures, there is illustrated there an apparatus 10 for processing particulates 12, such as fluidizing and compacting foundry sand or the like. It should be noted that the apparatus 10 may be used to fluidize and/or compact other particulates, if desired.

The apparatus 10 includes a base 14 (shown in complete form in FIG. 3) which comprises a tripod including three legs 16*a*,16*b*,16*c* joined by cross-bars 18*a*,18*b*,18*c*. (Only the cross-bars 18*b*,18*c* are visible in FIG. 3.)

A motor 20 includes a motor shaft 22 having first and second ends 24*a*,24*b* which extend outwardly in a vertical direction from the moror 20. At least one and preferably two eccentric weights 26*a*,26*b* are disposed on the first and second ends 24*a*,24*b* of the shaft 22. The eccentric weights 26*a*,26*b* include an arm 27*a*,27*b* releasably secured to the shaft 24. Weight blocks 28 are adjustably secured to the arms 27*a*,27*b* to increase or decrease the vibratory forces created by the rotation of the eccentric weights. Appropriate other well known means can be used to provide the eccentric weights on the shaft and to vary the relative positions of the weights with respect to the axis of the shaft and to each other. See my earlier U.S. Pat. Nos. 3,358,815 and 4,168,774. The motor 20 could be a variable speed motor with appropriate well known means for varying the motor speed as desired.

A housing 32 is secured to and encloses the motor 20. A plurality of threaded studs 34 extend through the housing 32 and are maintained in position by means of nuts 36. The threaded studs contact the motor casing and restrain it against movement within the housing 32. Any well known apparatus for securing the motor 20 to the housing 32 is contemplated.

Figure 4:
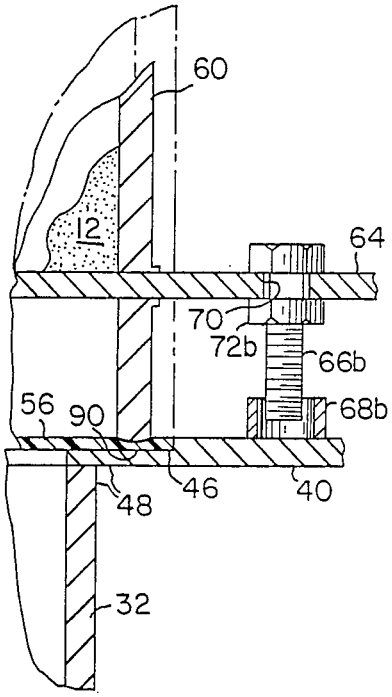
FIG. 4 is an enlarged fragmentary elevational view of a portion of the apparatus shown in the preceding figures with dashed lines added to illustrate the vibration of the apparatus in use.

Disposed atop the housing 32 is a horizontally disposed bed plate 40 having a main portion 42 and an offset flange portion 44 which defines a stepped channel or recess 46. The bed plate 40 is joined to the housing 32 by any suitable means, such as by the weld 48 shown in FIG. 4.

The motor 20, the eccentric weights 26, the housing 32 and the bed plate 40 together comprise a vibratory bed wherein operation of the motor 20 imparts vibrational motion to the housing and to the horizontally disposed bed plate 40. A suspension 50, preferably in the form of coiled springs 52*a*,52*b*,52*c* is disposed between the bed plate 40 and the base 14. The springs 52*a*,52*b* 52*c* could be resilient blocks or the like. The suspension 50 isolates the vibration of the vibratory bed, and more particularly the bed plate 40, from the base 14.

A cushion 56 in the form of an elastomeric body may be disposed within the recess 46 of the bed plate 40. In the illustrated form, a vessel 60 sits atop the cushion 56. The vessel 60 has a hollow interior 62 for holding the particulate material 12 and, in the case of a foundry operation, a pattern 61. The vessel 60 may be a conventional mold flask that is circular or square in cross-section, although it may have a different cross-sectional shape.

The vessel 60 includes an outer flange 64 which, when the vessel 60 is seated on the cushion 56, is vertically spaced above and is substantially parallel to the bed plate 40. At least one and preferably three alignment pins 66*a*,66*b*,66*c* extend through apertures in the flange 64 and project into at least one and preferably three positioning cups 68*a*,68*b*,68*c* secured to an upper face 70 of main portion 42 of the bed plate 40. The pins 66 have a diameter less than the inner diameter of the cups 68 so that a limited amount of lateral movement of the vessel 60 relative to the bed plate is permitted. This relative movement is somewhat dampened by the elastomeric cushion 56. This limited lateral relative movement between the vessel 60 and the bed plate 40 is shown by the dashed lines of FIG. 4 and is sufficiently small to prevent substantial rotation of the vessel 60 about its center axis relative to the bed plate 40. The alignment pins 66 and the cups 68, therefore, comprise means for maintaining substantial relative alignment of the vessel and bed plate.

In operation, as the motor 20 rotates, the eccentric weights 26a,26b impart vibrational energy to the bed plate 40 through the housing 32. The bed plate 40 vibrates in a vibrogyratory fashion wherein the axis 80 (FIG. 2) of the bed plate through the center thereof and perpendicular to the surface 70 is inclined from the vertical and defines substantially a conical surface as it vibrates. This vibratory motion is transmitted through the elastomeric cushion 56 to produce a gyratory vibrational motion of the vessel 60, as shown by the dashed lines in FIG. 2. During such operation, the base 14 remains substantially stationary owing to the isolation provided by the suspension 50.

The operation is carried out in two phases, fluidization and compaction. In phase one, the sand is fluidized by virtue of operating the vibration generator to produce accelerations in excess of gravity. Acting like a fluid, the sand fills all passages and cavities of a pattern suspended in the vessel 60. It has been found that as the acceleration approaches 1G the sand is being fluidized and/or compacted.

The amplitude of the vibrations is then reduced, by reducing rotational speed of the eccentric weights or by reducing the effective mass of the eccentric weights by using the system shown in U.S. Pat. No. 3,358,815 or in U.S. Pat. No. 4,168,774. Reducing the amplitude of vibrations so that the acceleration is less than gravity compacts the sand.

The vibrational gyratory motion of the bed plate causes the bed plate to impact the vessel at multiple frequencies. That is, the vertical components of the vibrations at various contact points, when the vibrational forces are in excess of the acceleration of gravity, produces multiple impacts between the bed plate and the vessel for each revolution of the shaft.

During the fluidization process, the motor develops sufficient vibrational forces in the bed plate 40 to create accelerations in excess of gravity. Portions of a bottom lip 90 (FIGS. 3 and 4) of the vessel 60 thereby vibrogyrationally move out of contact and into contact with the cushion 56 (if used) or a top surface 92 of the flange portion 44 (if the cushion 56 is not used). This action produces multiple impacts of the vessel 60 against the bed plate 40 so that the vessel 60 vibrates at various frequencies, even when the motor speed is constant. These frequencies have been found to consist of a fundamental frequency and integer multiples thereof wherein the fundamental frequency is the same as the rotational speed of the motor 20. This multi-frequency vibration readily fluidizes the particulates and minimizes the incidence of damage to a pattern in the vessel.

As an example, with the shaft rotating at 2140 RPM, the vibrational gyratory motion of the bed plate will impact the vessel with multiple impacts and at various frequencies with each revolution of the shaft. The various frequencies will be integer multiples of a fundamental frequency which is the same as the rotational speed of the motor. The number of impacts will be equal to or greater than the speed of the motor.

Applicant has conducted several tests of an apparatus constructed according to the foregoing details, each at a different motor speed, and has achieved the following results.

TABLE 1

| Motor Speed 2140 RPM | | | |
|---|---|---|---|
| Measured Vibrational Frequencies (strokes per minute) | Amplitude of Vibration Measured at a Particular Point on the Flange 64 (inches) | Calculated Acceleration of Vessel 60 (g's) | Integer Multiples of Motor Speed |
| 2140 | 0.022 | 1.43 | |
| 4280 | 0.003 | 0.78 | 2 |
| 8560 | 0.0013 | 1.35 | 4 |
| 12800 | 0.0005 | 1.16 | 6 |

TABLE 2

| Motor Speed 3000 RPM | | | |
|---|---|---|---|
| Measured Vibrational Frequencies (strokes per minute) | Amplitude of Vibration Measured at a Particular Point on the Flange 64 (inches) | Calculated Acceleration of Vessel 60 (g's) | Integer Multiples of Motor Speed |
| 3000 | 0.015 | 1.92 | |
| 6000 | 0.001 | 0.512 | 2 |
| 12000 | 0.0007 | 1.43 | 4 |
| 18000 | 0.00025 | 1.15 | 6 |

TABLE 3

| Motor Speed 2500 RPM | | | |
|---|---|---|---|
| Measured Vibrational Frequencies (strokes per minute) | Amplitude of Vibration Measured at a Particular Point on the Flange 64 (inches) | Calculated Acceleration of Vessel 60 (g's) | Integer Multiples of Motor Speed |
| 2500 | 0.0023 | 0.204 | |
| 5000 | 0.0019 | 0.675 | 2 |
| 12600 | 0.00026 | 0.586 | 5 |
| 17600 | 0.0002 | 0.88 | 7 |
| 22400 | 0.00017 | 1.21 | 9 |

Figure 3:
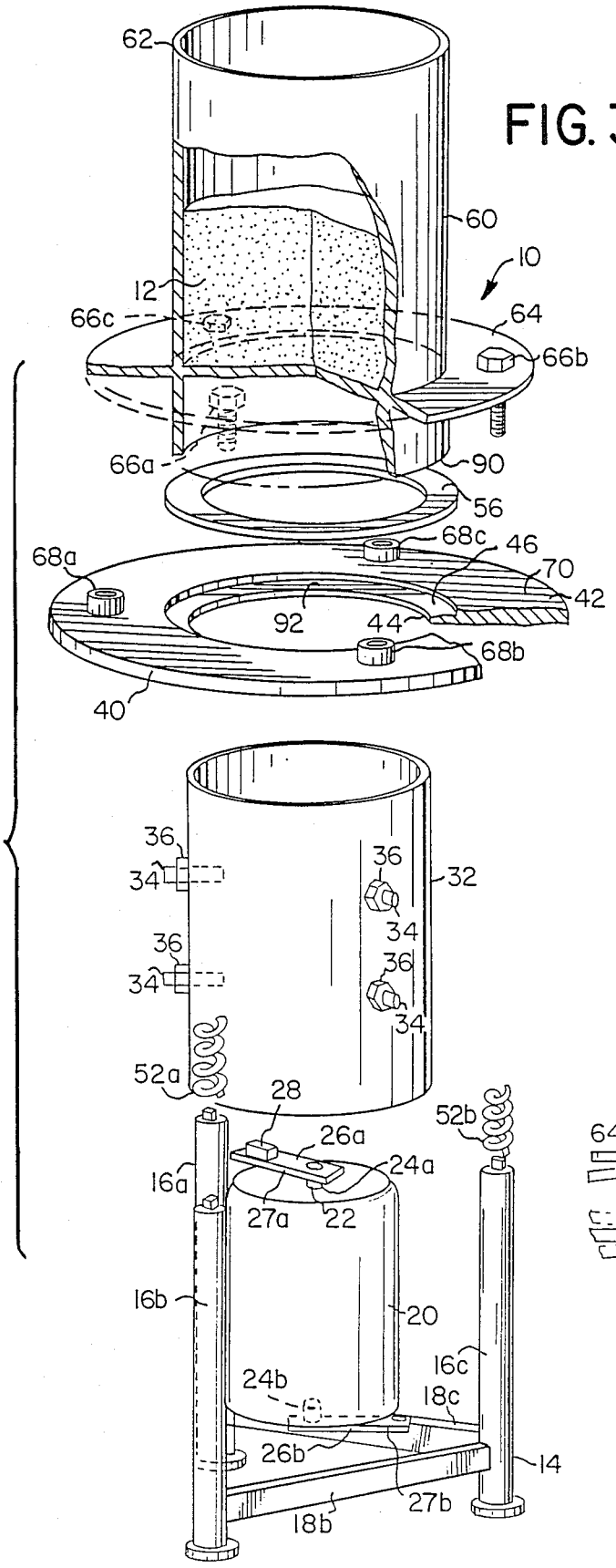
FIG. 3 is an exploded perspective view of the apparatus shown in FIGS. 1 and 2 with portions broken away to reveal the construction thereof.
Figure 5:
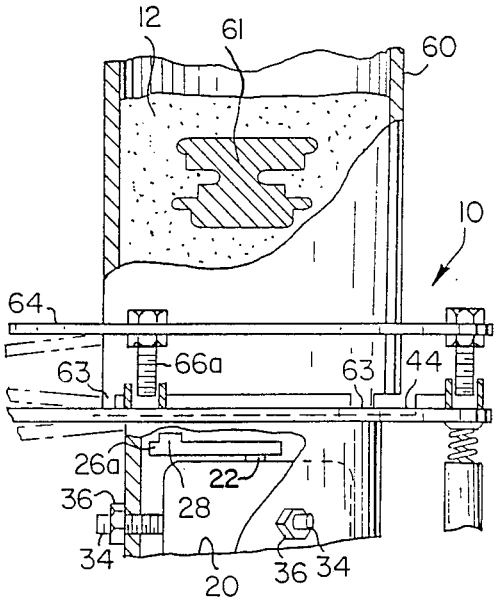
FIG. 5 is a partial elevational view of a modified form of the invention with the vessel supported on at least three points and a pattern in the vessel.

FIG. 5 shows a modified form of the invention wherein all of the parts that are the same as in FIG. 3 are identified with the same numerals. The vessel 60 containing, for instance, sand 12 and a pattern 61 has three equally spaced apart protrusions, contact pads or contact points 63 extending downwardly from the lower edge 90 (only 2 of the protrusions or pads 63 are visible in FIG. 5). The pads 63 contact either the ring 56, when a ring is used, or the flange surface 44 when no ring is used. The three contact pads or points 63 locate the impact surfaces between the bed plate 40 and the vessel so that the impact frequencies caused by the multiple impacts between the bed plate and the vessel are limited to three. An increase in the number of contact points or pads will increase the number of impact frequencies by the same number.

The ratio of impact frequency to shaft rotation in RPM between the bed plate and the vessel, in the range of contact points between at least 3 and up to approximately 10, is a function of the number of support points between the vessel and the bed plate. Increase the number of contact points increases the ratio of impact frequency to shaft rotation speed in RPM.

FIGS. 6–11 show a further modified form of the invention having contact structures 165 between the bed plate 140 and the flask or vessel 160 and wherein the only contact between the bed plate 140 and the vessel 160 is through the contact structures 165. In addition, the modified form also illustrates one specific form of remotely adjustable variable force vibratory generating apparatus and the improved operating conditions accomplished therewith.

In FIG. 6, the apparatus 110 has a base 114 with four legs 116 isolated from a bed plate 140 by springs 152. The bed plate 140 has a housing 132 for supporting a vibratory generating apparatus 125 having a vertically oriented motor 120. The vibratory generating apparatus 125 includes separately housed remotely actuated variable force generating members 135 and 145 operatively connected to the vertical shaft 122 of the motor 120.

Referring specifically to FIGS. 6–10, the bed plate 140 is illustrated as having three contact structures 165 although more than three such structures could be used. Each contact structure 165 includes a pin 166 secured to the top surface or upper face 170 of the bed plate 140 and has an end portion 172 with a frusto-conical surface 174. The slope of the conical surface 172 is illustrated as being about 30° with an angle of up to approximately 45° being the preferred range. Each contact structure 165 also includes a socket portion 168 secured to the under surface or lower face 176 of the vessel or flask 160 and has a recess 178 with a frusto-conical surface 180 having an angle of slope mating with the angle of slope of the surface 174 on the pin 166. It should be noted that in the apparatus of FIG. 6 the only support between the bed plate 140 and the vessel 160 is through the contact structures 165. The sloping surfaces of any one of the frusto-conical pins and frusto-conical sockets, when mating and in contact, will restrain the flask movement in the horizontal direction to be the same as the horizontal movement of the bed plate. When the vertical components of the gyratory motion exceeds gravity at or near a pin that point of the flask lifts vertically from the pin and becomes an impact point which impact point moves progressively from pin-to-pin in the vibrogyratory system described previously with respect to the structure shown in FIGS. 1–5.

In FIG. 9 the frusto-conical surface 174 on the pin 166 seats in the frusto-conical surface 180 in the socket portion 168 before the end face 182 on the pin 166 bottoms or abuts against the base surface 184 of the recess 78. It has been found that with anyone of the pins 166 seated in the sockets 168 with only the frusto-conical surfaces in contact, the horizontal motion of the vessel will be restrained to be the same as the horizontal motion of the bed plate 140 during vibratory fluidization and/or compaction of particulate material in the vessel. The slope of the frusto-conical surface on the pin and in the recess restrains the pin to the socket in the horizontal drection for direct transmission of horizontal vibratory motion from the bed plate to the vessel. That is, and as will become more evident hereinafter, as the vibratory apparatus is adjusted to provide the desired horizontal vibratory component, the contact structures 165 will transmit that horizontal component directly from the bed plate to the vessel when the frusto-conical surfaces are in direct contact in at least one contact structure.

When, the vibratory apparatus is operating with its acceleration below one g (below gravity), the contact structures 165 in effect lock the flask or vessel 160 to the bed plate 140 so that the horizontal and vertical components of the vibrogyratory forces act directly from the bed plate into the flask or vessel. When the acceleration of any of the vertical vibrogyratory forces exceed gravity, the sockets on the flask nearest to said high vertical force component will be impacted by the pin with sufficient force as to separate or lift the socket from the pin. The lifting and impacting will progress from pin-to-pin in a continuous cycle producing an accentuated gyratory action in the flask or vessel which fluidizes the particulates and increases the flow of particulates into the crevices or depressions in the pattern in the flask. It has been found that for patterns for making delicate parts, the operation of the apparatus at accelerations in excess of gravity can damage the patterns. However, it has also been found that flasks containing such patterns can be effectively and efficiently prepared for casting by compacting the particulates at accelerations below gravity using the improved contact structures and tuning the hereinafter described vibratory generating apparatus.

In FIG. 10, the frusto-conical surface 174 on the pins 166 are such as to be spaced from the frusto-conical surface 180 in the socket 168 so that the end face 182 on the pin 166 abuts the base surface 184 of the recess 178. The pins and sockets serve only to prevent excessive rotation of the vessel relative to the bed plate while permitting the transmission of vertical vibratory components and conventional horizontal vibratory components from the bed plate to the vessel. The vertical vibratory motion from the bed plate acts axially through the pins into the vessel.

It is contemplated that either the pins 166 or the sockets 168 can be replaced to convert the apparatus for use from the condition where the frusto-conical surfaces mate and engage each other continuously (FIG. 9) to the condition where the frusto-conical surfaces are spaced from each other (FIG. 10).

FIGS. 11–14 illustrate one particular form of remotely actuated force generating structure and the particular manner that the variable force generating structure is used advantageously with the present apparatus. For present purposes, vibratory apparatus having a variable lead angle and force of the type shown, described and claimed in my recently issued U.S. Pat. No. 4,617,832 is used.

The motor 120 has a shaft 122 not only extending upwardly into the shell 186 and to an end portion of which shaft the vibratory apparatus 145 is attached but also extending downwardly into the shell 188 and to the other end portion of the shaft the vibratory apparatus 135 is attached.

The vibratory apparatus 135 and 145 are identical so that only one will be briefly described. As is shown in FIGS. 12, 13 and 14, a circular plate 322 is keyed to the shaft 122 of the motor, which plate 322 has a plurality of threaded holes 324 equally spaced apart on a circle which has its center at the center of the plate. A fixed weight 326 of pie-shaped configuration has an aperture 327 at its pointed portion 328 encircling the shaft 318 and in its unattached form is free to rotate relative to the shaft of the motor. The fixed weight 326 has holes 330 through which bolts 332 pass before being threaded into selected threaded holes 324 in the mounting plate. As illustrated, it is contemplated that the fixed weight can be positioned in any one of eight different locations around a circle defined by the mounting plate.

A cylindrical housing 334 is secured to the mounting plate 322 with the axis 340 of the housing coinciding the axis 319 of the shaft 122 of the motor 120 so that the housing 334 will rotate about the axis of the shaft. Mounted within the cylindrical housing is an elongate cylinder member 342 which has an elongate longitudinal axis 344 through the center thereof, which axis 344 intersects the axis 340 of the housing and the axis 319 of the shaft at right angles thereto.

FIG. 12 illustrates the fixed weight 326 bolted to the plate with its center of gravity 333 (CG) lying on a center line 345 passing through the axis 319 of the motor which center line coincides with the axis 344 of the cylinder 342. FIG. 13 illustrates the fixed weight 326 fixed to the plate 322 with its center of gravity (CG) 333 lying on the centerline 345 passing through the axis 319 of the motor and defining an angle of 45° to the center line 344 of the cylinder 342. FIG. 14 illustrates the fixed weight 326 bolted to the plate 322 with its center of gravity 333 (CG) lying on a centerline 345 passing through the axis 319 of the motor and defining an angle of 90° to the centerline 344 of the cylinder 342.

Slidably mounted in the cylinder 342 is a movable weight 352 with a spring 350 connected between the weight 52 and the end wall of the cylinder. In the at rest condition of the apparatus as shown, the spring holds the movable weight 352 with its center of gravity (CG) 356 on the same side of the axis 319 of the shaft 122 as is the center of gravity 333 of the fixed weight 326. A conduit (not shown) is connected to part 361 to supply pressure to the movable weight 352 in the cylinder.

As shown in FIG. 12 there is a 0 lead angle between the center line 345 of the fixed weight and the center line 344 of the movable weight so that the vibratory force to the vessel is varied from 0 to a maximum depending on the position of the movable weight 352 relative to the fixed weight. As shown in FIG. 13 and FIG. 14, the angle between the center line 345 of the fixed weight and the center line 344 of the movable weight in the cylinder is 45° and 90°, respectively. Rotation of the apparatus and controlling the pressure into the cylinder 342 will locate the movable weight relative to the fixed weight such that the resultant of the centrifugal forces of the fixed weight and movable weight will be between the two weights in an amount dependent upon the amount of the two weights. The angle between the longitudinal axis of the movable weight and the resultant is the lead angle which determines the amount of vibratory motion transmitted to the vessel. The lead angle and thus the extent of the vibratory motion is varied by admitting or removing pressure in the cylinder. For a detailed explanation of the structure of the vibratory apparatuses 135 and 145 and how they operate, reference is again made to my issued U.S. Pat. No. 4,617,832 issued Oct. 21, 1986.

Figure 2:
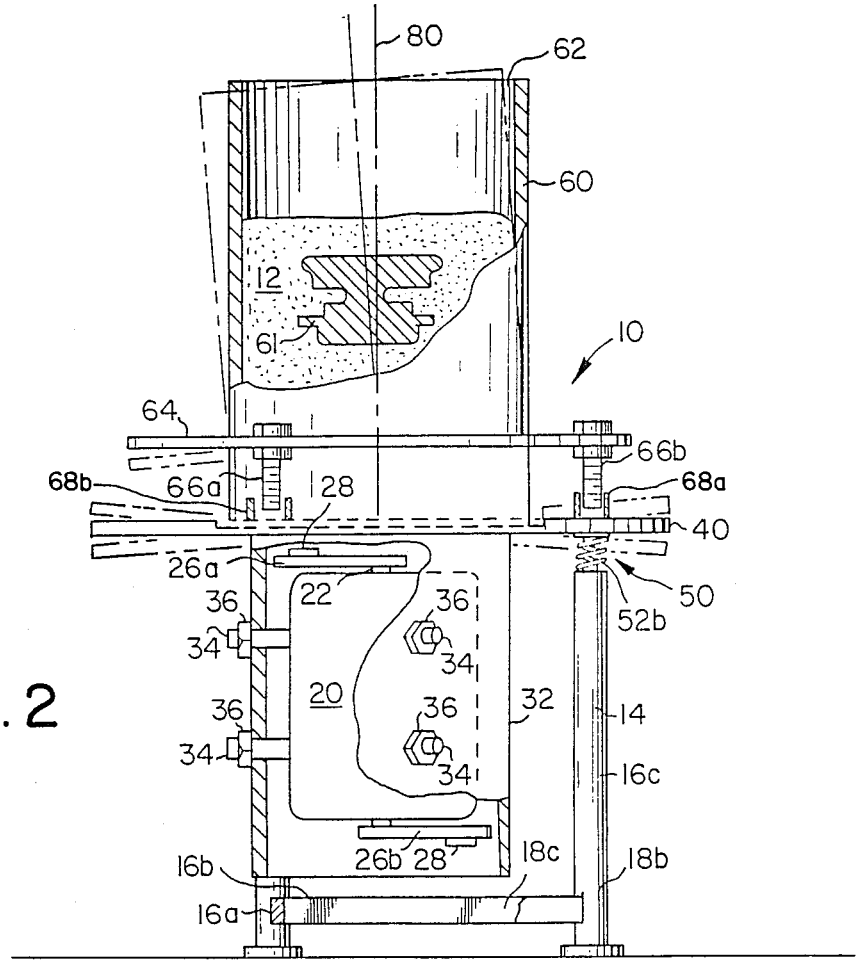
FIG. 2 is an elevational view of the apparatus shown in FIG. 1 with portions broken away to reveal the structure thereof and with dashed lines added to illustrate the vibration of the apparatus when in use.

The upper vibratory apparatus 145 is used to control the horizontal vibratory forces acting on the vessel while the lower vibratory apparatus 135 is used to control the vibrogyratory forces about a theoretical conical path, i.e. as subscribed by the axis 80 as shown in FIG. 2. That is, the horizontal movements of the particulate material in the vessel is increased or decreased depending on the setting of the upper vibratory apparatus which setting can be made within a range by remotely applying pressure in the cylinder to set the movable weight relative to the fixed weight. In the event a significant increase in horizontal vibratory motion is desired, the fixed weight 326 is reset on the plate 322 after which, during operation of the vibratory apparatus 145, the horizontal forces can be controlled within a wide range by the application or withdrawal of pressure in the cylinder to reset the location of the movable weight relative to the fixed weight.

The lower vibratory apparatus 135 is used to control the vibrogyratory forces acting on the vessel. The lower vibratory apparatus 135 is initially set by selecting an approximate location of the axis of the fixed weight 326 with respect to the axis of the cylinder having the movable weight. During operation, the location of the movable weight in the cylinder is controlled remotely by the application of pressure in the cylinder to set the location of the movable weight relative to the fixed weight. The lower vibratory apparatus 135 will control the conical vibrogyratory action which provides a vertical component to the particulate material. The combined horizontal component from upper vibratory apparatus 145 and vertical component from lower vibratory apparatus 135 will produce a motion of particulate material in the vessel that will circulate, mix, abrade or whatever. When used as a compaction table, the combined vibratory motions may be used first to fluidize the particulate material whereby the material flows into the crevices and cavities in the pattern 61 and then when the forces are reduced to below 1g, the combined vibratory motions comaact the particulate material about the pattern. The different settings of the upper and lower vibratory apparatus 145, 135 respectively combining to produce the improved results.

I claim:

1. Apparatus for processing particulates, comprising:

a vibratory bed including a horizontally disposed bed plate, a support carried by the bed plate, a vertically disposed shaft carried by the support and at least two eccentric weights vertically spaced apart on the shaft, said weights being radially adjustable relative to the shaft and circumferentially adjustable relative to each other, wherein rotation of the shaft imparts vibrational gyratory motion to the bed plate; and a vessel for the particulates carried atop the bed plate, means between the vessel and the bed plate for permitting unrestrained vertical motion between the vessel and the bed plate and for limiting relative horizontal motion between the vessel and the bed plate, wherein the vessel is movable relative to the bed plate such that vibrational gyratory motion of the bed plate impacts the vessel to cause the vessel to vibrate at multiple frequencies for fluidizing or compacting the particulates in the vessel.

2. The apparatus of claim 1 wherein the shaft is driven by a motor mounted on the support.

3. The apparatus of claim 1 further including a base and a suspension coupling the vibratory bed to the base.

4. The apparatus of claim 1 wherein the means for limiting relative horizontal motion between the vessel and bed plate comprises means for retaining the vessel in substantial vertical alignment with the bed plate.

5. The apparatus of claim 1 including a cushion means between the vessel and the bed plate.

6. Apparatus for processing particulates comprising:

a vibratory bed having a planar bed plate, a support on the bed plate, a motor carried by the support and having a vertically disposed shaft and at least two vertically spaced eccentric weights disposed on the shaft, at least one of said weights being radially adjustable relative to the other weight wherein operation of the motor imparts vibrational gyratory motion to the bed plate;

a base;

a suspension coupled between the bed plate and the base for isolating the vibration of the bed plate;

a vessel loosely carried by the bed plate for holding the particulates, means for restraining relative horizontal motion between the vessel and the bed plate and for permitting relative vertical motion between the vessel and the bed plate; and wherein the vibrational gyratory motion of the bed plate when in excess of the acceleration of gravity imparts multiple impacts upon the vessel with each revolution of the shaft so that the particulates in the vessel vibrate at multiple frequencies so as to fluidize or to compact the particulates in the vessel.

7. The apparatus of claim 6 wherein the motor is driven at a selected speed so that the bed plate impacts the vessel to vibrate the particulate therein at the multiple frequencies which are integer multiples of a fundamental frequency which is determined by the speed of the motor.

8. Apparatus for processing particulates, comprising:

a vibratory bed including a horizontally disposed bed plate, a support carried by the bed plate, a vertically disposed shaft carried by the support, at least two vibratory generating means vertically spaced apart on the shaft, at least one of said vibratory generating means having a weight radially adjustable relative to the shaft and circumferentially adjustable relative to the other vibratory generating means wherein rotation of the shaft imparts vibrational gyratory motion to the bed plate;

a vessel for the particulates carried by the bed plate, at least three pin means equally spaced apart on said bed plate and projecting upwardly, a frusto-conically shaped surface on the end portion of each pin means, and at least three socket means equally spaced apart on said vessel in alignment with said pin means, a downwardly open recess in said socket means having a frusto-conically shaped surface defining a wall thereof, said pin means nesting in said socket means with at least one of said frusto-conically shaped surfaces on a pin means being in direct contact with at least one mating frusto-conically shaped surface in a socket mens whereby the vessel movement in the horizontal direction is restrained to the same horizontal movement as the bed plate and the vertical component of the vibrational gyratory motion when in excess of gravity will lift the vessel vertically from successive pins as the particulates are fluidized in the vessel.

9. The apparatus of claim 8 wherein the shaft is driven by a motor mounted on the support.

10. The apparatus of claim 9 wherein one separate vibratory generating means is disposed on each end of the shaft on opposite sides of the motor.

11. The apparatus of claim 10 wherein each vibratory generating means includes remotely controlled means for varying the vibratory forces generated by said vibratory generating means.

12. Apparatus for processing particulates comprising:

a vibratory bed plate, a motor suspended from the bed plate having a vertically disposed shaft with spaced end portions, vibration generating means mounted on each end portion of said shaft for imparting vibrational gyratory a vessel;

means for loosely supporting the vessel on the bed plate;

said support means comprising plural contact means fixed to at least one of the vessel and the bed plate component of the vibrational gyratory motion when in excess of gravity to lift the vessel from the bed plate progressively from one contact means to the next; and whereby the vibrational gyratory motion of the bed plate will impact the vessel with multiple impacts and various frequencies with each revolution of the shaft so as to fluidize or compact the particulates in the vessel.

13. The apparatus of claim I2 wherein said contact means comprises at least three pin means carried by said bed plate and projecting upwardly therefrom, each pin means having a frusto-conical shaped end portion;

said plural contact means also comprises at least three socket means carried by said vessel and being aligned with said pin means, each socket means having a recess with a frusto-conical shaped wall portion, and at least one of said pin means engaging in said socket means with said frusto-conical shaped end portion in contact with said frusto-conical shaped wall portion in the recess to restrain the vessel movement in the horizontal direction to be the same as the horizontal movement of the bed plate.

14. Apparatus for processing particulates, comprising:

a vibratory bed plate, a vertically disposed shaft carried by the bed plate, at least two vertically spaced apart vibratory generating means disposed on the shaft wherein rotation of the shaft imparts vibrational gyratory motion to the bed plate;

a vessel;

plural contact structure between the vessel and the bed plate;

said contact structure comprising at least three pin means projecting upwardly from said bed plate;

a frusto-conically shaped surface on the upper end portion of each pin means, and at least three socket means on said vessel in alignment with said pin means, a downwardly open recess in each socket means having a frusto-conically shaped wall, whereby when said frusto-conically shaped surface and wall are in contact said vessel is restrained in the horizontal direction to the same horizontal movement as said bed plate and the vertical vibratory movement of the bed plate will lift said vessel progressive from pin means to pin means when said vertical component of said vibrational gyratory motion is in excess of gravity to thereby fluidize said particulates in said vessel.

15. Apparatus for processing particulates, comprising:

a vibratorybbed plate, a vertically disposed shaft carried by the bed plate, at least one vibratory generating means disposed on the shaft for imparting vibrational gyratory motion to the bed plate as the shaft is rotated;

a vessel; and means for permitting unrestrained vertical motion between the vessel and the bed plate and for limiting relative horizontal motion between the vessel and the bed plate, said means includes means fixed to at least one of the vessel and the bed plate;

said vibratory generating means compriisng a cylinder having a weight movable along an axis transverse to the axis of the shaft, a weight that can be selectively fixed in a plurality of positions and initially positioned so as to have a center of gravity lying along a line forming an angle with the axis of the cylinder, and remotely operative means for moving the movable weight to a desired position relative to the fixed weight whereby a resultant force is generated having a lead angle and vibratory force that will cause the bed plate to impact the vessel and thereby produce desired fluidization and/or compaction of particulates in the vessel.

16. The apparatus of claim 17 wherein said vibration generating means has means for changing the lead angle and for remotely changing the vibratory force whereby horizontal and vertical vibratory forces acting on the particulate material more effectively fluidize and/or compact the material.

17. The apparatus of claim 16 wherein there are at least two vertically spaced apart vibration generating means, the uppermost vibration generating means has the lead angle set for a desired horizontal movement of the particulate material and the lowermost vibration generating means has the lead angle set for a desired vibrational gyratory motion affecting the vertical movement of the particulate material.

18. The apparatus of claim 15 wherein two separate vertically spaced apart vibratory generating means are provided and are mounted one each on opposite end portions of the shaft and wherein the uppermost vibratory generating means is adjusted to vary the horizontal components of movement of the particulates and the lowermost vibratory generating means is adjusted to vary the vibrational gyratory motion of the particulates.

19. Apparatus for processing particulates, comprising:

a vibratory bed plate means, a vertically disposed shaft carried by the bed plate means, at least two vertically spaced apart vibratory generating members disposed on the shaft wherein rotation of the shaft imparts vibrational gyratory motion to the bed plate means;

a vessel means;

contact structures between said vessel means and said bed plate means;

said contact structures comprising at least three pin-like members projecting from one of said means;

a frusto-conically shaped surface on the exposed end portion of each pin like member, and at least three socket members on the other of said means in alignment with said pin-like members, a recess in each socket member having a frusto-conically shaped wall, whereby when at least one of said frusto-conically shaped surfaces and walls are in contact, said vessel means is restrained in the horizontal direction to the same horizontal motion as the bed plate means and when the vibratory generating member is producing a vertical component in excess of gravity the vessel means will lift from the bed plate means progressively from one pin-like member and socket member to the next.

* * * * *

UNITED STATES PATENT AND TRADEMARK OFFICE

CERTIFICATE OF CORRECTION

PATENT NO. : 4,859,070

DATED : August 22, 1989

INVENTOR(S) : ALBERT MUSSCHOOT

It is certified that error appears in the above-identified patent and that said Letters Patent is hereby corrected as shown below:

Column 1, line 28, after "apparatus" change "havigg" to --having--.

Column 2, line 10, after "compact" change "thepparticulates" to --the particulates--;
line 12, after "one" change "cceentric weightddisposed" to --eccentric weight disposed--;
line 13, change the first word "nn" to --on--.

Column 3, line 49, change "1" to --11--;
line 59, after "illustrated" change "there" to --therein--.

Column 4, line 3, change "moror" to --motor--;
line 6, change "include" to --includes--.

Column 7, line 43, change "78" to --178--;
line 60, after "When" delete the comma (",").

Column 10, line 20, after "motions" change "comaact" to --compact--;

Column 9, line 18, change "52" to --352--.

Column 11, line 42, change "mens" to --means--;
line 63, after "gyratory" insert --motion to the bed plate;--

Column 12, line 54, change "vibratorybbed" to --vibratory bed--

Signed and Sealed this

Twenty-second Day of January, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,859,070

DATED : August 22, 1989

INVENTOR(S) : Albert Musshoot

It is certified that error appears in the above-identified patent and that said Letters Patent is hereby corrected as shown below:

Column 11, after line 68, insert --plural contact means between the bed plate and the vessel for restraining the vessel movement in the horizontal direction to be the same as the horizontal movement of the bed plate and for permitting the vertical--;

Column 13, line 11, "17" should be --15--;
line 11, after "wherein" --each-- should be inserted.

Signed and Sealed this

Twenty-first Day of July, 1992

*Attest:*

DOUGLAS B. COMER

*Attesting Officer*

*Acting Commissioner of Patents and Trademarks*